US007341045B2

(12) United States Patent
Sims, Jr. et al.

(10) Patent No.: US 7,341,045 B2
(45) Date of Patent: Mar. 11, 2008

(54) HYDRAULIC DAMPER ELEMENT

(75) Inventors: Dewey M. Sims, Jr., Wayne, MI (US); Hursha Shankaranarayan, Farmington Hills, MI (US)

(73) Assignee: Robert Bosch GmbH, Stuttgart (DE)

( * ) Notice: Subject to any disclaimer, the term of this patent is extended or adjusted under 35 U.S.C. 154(b) by 384 days.

(21) Appl. No.: 10/966,931

(22) Filed: Oct. 15, 2004

(65) Prior Publication Data

US 2006/0081220 A1 Apr. 20, 2006

(51) Int. Cl.
*F02M 37/04* (2006.01)

(52) U.S. Cl. ..... 123/467; 123/456; 138/30

(58) Field of Classification Search ..... 123/467, 123/456, 514, 494, 447; 138/30, 28, 26
See application file for complete search history.

(56) References Cited

U.S. PATENT DOCUMENTS

| | | | | |
|---|---|---|---|---|
| 2,409,304 | A | 10/1946 | Morrison | |
| 4,649,884 | A * | 3/1987 | Tuckey | 123/457 |
| 4,651,781 | A | 3/1987 | Kandelman | |
| 4,660,524 | A | 4/1987 | Bertsch et al. | |
| 4,729,360 | A | 3/1988 | Fehrenbach et al. | |
| 4,823,844 | A | 4/1989 | Bartholomew | |
| 5,024,198 | A | 6/1991 | Usui | |
| 5,575,262 | A | 11/1996 | Rohde | |
| 5,617,827 | A | 4/1997 | Eshleman et al. | |
| 5,709,248 | A | 1/1998 | Goloff | |
| 5,845,621 | A | 12/1998 | Robinson et al. | |
| 5,896,843 | A | 4/1999 | Lorraine | |
| 6,032,651 | A | 3/2000 | Field | |
| 6,205,979 | B1 | 3/2001 | Sims, Jr. et al. | |
| 6,314,942 | B1 | 11/2001 | Kilgore et al. | |
| 6,371,083 | B1 | 4/2002 | Rossi et al. | |
| 6,390,131 | B1 * | 5/2002 | Kilgore | 138/30 |
| 6,418,909 | B2 | 7/2002 | Rossi et al. | |
| 6,513,500 | B2 | 2/2003 | Braun et al. | |
| 6,655,354 | B2 | 12/2003 | Curran et al. | |
| 6,672,286 | B2 * | 1/2004 | Miandoab et al. | 123/456 |
| 6,761,150 | B2 | 7/2004 | Zdroik | |
| 6,935,314 | B2 * | 8/2005 | Zdroik et al. | 123/456 |
| 2004/0035399 | A1 | 2/2004 | Curran et al. | |
| 2004/0107943 | A1 | 6/2004 | Alder et al. | |

* cited by examiner

*Primary Examiner*—Carl S. Miller
(74) *Attorney, Agent, or Firm*—Michael Best & Friedrich LLP

(57) ABSTRACT

A damper for damping pressure pulsations in a liquid includes an outer tube having an inner surface defining an interior cavity, and an inner tube positioned within the interior cavity of the outer tube. The inner tube includes an outer surface such that at least one chamber is formed between the inner surface of the outer tube and the outer surface of the inner tube for containing a gas. The damper includes an exterior surface configured to be surrounded by the liquid and an interior surface configured to define a passageway through the damper for the liquid. The damper can define at least two, and in one embodiment, four separate chambers for containing a gas. The damper can be part of a fuel rail assembly and is positioned within a fuel rail configured to contain pressurized fuel.

57 Claims, 6 Drawing Sheets

HYDRAULIC DAMPER ELEMENT

FIELD OF THE INVENTION

The invention relates to fuel rails for the fuel system of an internal combustion engine, and more particularly to damper elements located within the fuel rails for damping pressure pulsations created by the fuel injectors.

BACKGROUND OF THE INVENTION

It is known to use damper elements within the fuel rails of fuel-injected fuel systems. The damper elements minimize the otherwise negative effects (e.g., fuel line hammering, improper fuel distribution to injectors, etc.) that can result from pressure pulsations within the fuel rail.

SUMMARY OF THE INVENTION

Recently, fuel systems are being designed to include high-pressure fuel rails that operate at pressures ranging from about 4 to 150 bar above the ambient pressure. These high-pressure fuel rails help reduce the droplet size of fuel exiting the fuel injectors, thereby lowering the overall emissions from the fuel system. Most existing fuel rail damper elements are not suited for use in these high pressure fuel rails. The existing damper elements may be plastically deformed at these high pressures, thereby reducing or eliminating their ability to effectively dampen pressure pulsations.

The present invention provides an improved damper element capable of operating effectively in high-pressure fuel rails. While the improved damper element is well-suited for use in these high-pressure fuel rails, it also provides a more efficient alternative for use in lower pressure fuel rail systems (e.g., about 2 to 4 bar above the ambient pressure). The improved damper element is generally the same size as prior art dampers, but is designed to have a better change in compressed gas volume per change in fuel pressure ratio. The damper element includes a higher frequency response range and better self-damping characteristics than prior art dampers. Additionally, the damper element maintains a relatively low cost.

More specifically, the invention provides a damper element for damping pressure pulsations in a liquid. The damper element includes an outer tube having an inner surface defining an interior cavity, and an inner tube positioned within the interior cavity of the outer tube. The inner tube includes an outer surface such that at least one chamber is formed between the inner surface of the outer tube and the outer surface of the inner tube for containing a gas.

In one aspect of the invention, at least two chambers are formed between the inner surface of the outer tube and the outer surface of the inner tube. The at least two chambers can be symmetrically positioned about a longitudinal axis of the damper element. In another aspect of the invention, the damper element is part of a fuel rail assembly and is positioned within a fuel rail configured to contain fuel.

The present invention also provides a damper element including an exterior surface configured to be surrounded by a liquid, an interior surface configured to define a passageway through the damper element for the liquid, and at least one chamber formed between the interior and exterior surfaces for containing a gas.

In one aspect of the invention, at least two chambers are formed between the interior and exterior surfaces for containing a gas, and the at least two chambers are spaced apart by the passageway. In another aspect of the invention, the damper element is part of a fuel rail assembly and is positioned within a fuel rail configured to contain fuel.

The invention further provides a damper element constructed of inner and outer tubes such that the outer tube has a wall portion extending away from the inner tube and the inner tube has a wall portion extending away from the outer tube. The wall portions are generally aligned with one another to define therebetween at least a portion of a chamber for containing a gas. In one embodiment, the outer tube includes opposite convexly-contoured side portions interconnected by opposite arcuate portions, and the inner tube includes opposite concavely-contoured side portions interconnected by opposite arcuate portions. A first chamber is formed between one of the convexly-contoured side portions of the outer tube and one of the concavely-contoured side portions of the inner tube, and a second chamber is formed between the other of the convexly-contoured side portions of the outer tube and the other of the concavely-contoured side portions of the inner tube.

The invention further contemplates a method of designing the inner and outer tubes of the damper element using finite element analysis (FEA) or other suitable modeling techniques to achieve the desired cross-sectional tube configurations. Starting with a generally oval shape for the inner tube, a small external pressure (P1)) is applied to the FEA model to determine the maximum stress (S1max) in this model as a function of this small external pressure (P1)). The fatigue endurance strength (ES) based on the tube material being modeled is known. Next, a new external pressure (P2)) substantially equal to ((ES/S1max)*P1)) is applied to the model to determine the deflection that will ultimately define the concavely-contoured side portions. Then, if it is verified that the maximum stress in this FEA model at the new pressure (P2)) is substantially equal to the fatigue endurance strength (ES) of the material, the shape of the inner tube that was created by the external pressure (P2)) will be used for the manufactured inner tube in its free state (i.e., the shape with no pressure acting on the inner tube). To verify that this resultant cross-sectional shape for the inner tube is appropriate, it is then modeled with an internal pressure (P2)) applied to the FEA model with the following results: (1) the maximum stress (S1max) was equal to the fatigue endurance strength (ES); and (2) the shape returned to the original generally oval shape. The inner tube can then be formed to this shape via extrusion or other suitable forming processes.

The outer tube is designed similarly. Starting with a generally oval shape for the outer tube, a small internal pressure (P1)) is applied to the FEA model to determine the maximum stress (S1max) in this model as a function of this small internal pressure (P1)). The fatigue endurance strength (ES) based on the tube material being modeled is known. Next, a new internal pressure (P2)) substantially equal to ((ES/S1max)*P1)) is applied to the model to determine the deflection that will ultimately define the convexly-contoured side portions. Then, if it is verified that the maximum stress in this FEA model at the new pressure (P2)) is substantially equal to the fatigue endurance strength (ES) of the material, the shape of the outer tube that was created by the internal pressure (P2)) will be used for the manufactured outer tube in its free state (i.e., the shape with no pressure acting on the outer tube). To verify that this resultant cross-sectional shape for the outer tube is appropriate, it is then modeled with an external pressure (P2)) applied to the FEA model with the following results: (1) the maximum stress (S1max) was equal to the fatigue endurance strength (ES); and (2) the shape returned to the original generally oval shape. The outer tube can then be formed to this shape via extrusion or other suitable forming processes.

To assemble the damper element, the inner tube can be press-fit into the outer tube. In one aspect of the invention, the press-fitting results in at least two longitudinally-extending zones of contact defined between the outer and inner tubes to define at least two chambers between the inner surface of the outer tube and the outer surface of the inner tube. Finally, the ends of the outer tube are sealed to the respective ends of the inner tube to form the at least two sealed chambers.

Other features and advantages of the invention will become apparent to those skilled in the art upon review of the following detailed description, claims, and drawings.

Figure 1:
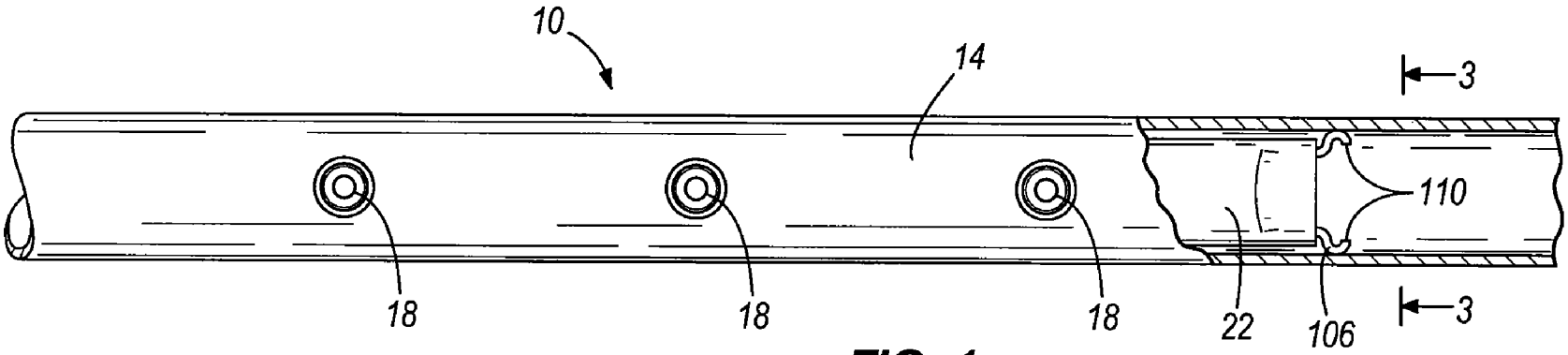
FIG. 1 illustrates a portion of a fuel rail, partially broken away, and containing a damper element embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having" and "comprising" and variations thereof herein is meant to encompass the items listed thereafter and equivalents thereof as well as additional items.

DETAILED DESCRIPTION OF THE PREFERRED EMBODIMENT

FIG. 1 illustrates a fuel rail assembly 10 including a fuel rail 14 and a plurality of fuel injectors 18 coupled to the fuel rail 14. The illustrated fuel rail 14 is configured to contain fuel pressurized from about 4 bar to about 150 bar above the ambient pressure. A damper element 22 embodying the invention is positioned inside the fuel rail 14 for damping pressure pulsations in the fuel that are created by the operation of the fuel injectors 18. The damper element 22 is well-suited for operation within the pressure ranges set forth above, and the damping characteristics of the damper element 22 will not be significantly affected by the standard operating temperatures within the fuel rail 14. Additionally, the illustrated damper element 22 can also be used in lower pressure fuel rail systems typically operating at about 2 to about 4 bar above ambient pressure, and provides a more efficient alternative to existing damper elements.

FIGS. 2-10 illustrate the damper element 22 in greater detail. While the damper element 22 is illustrated as being used in conjunction with a fuel-injected fuel system, it is to be understood that the damper element 22 can also be used in other applications where pressure pulsations within a liquid require damping.

Figure 2:
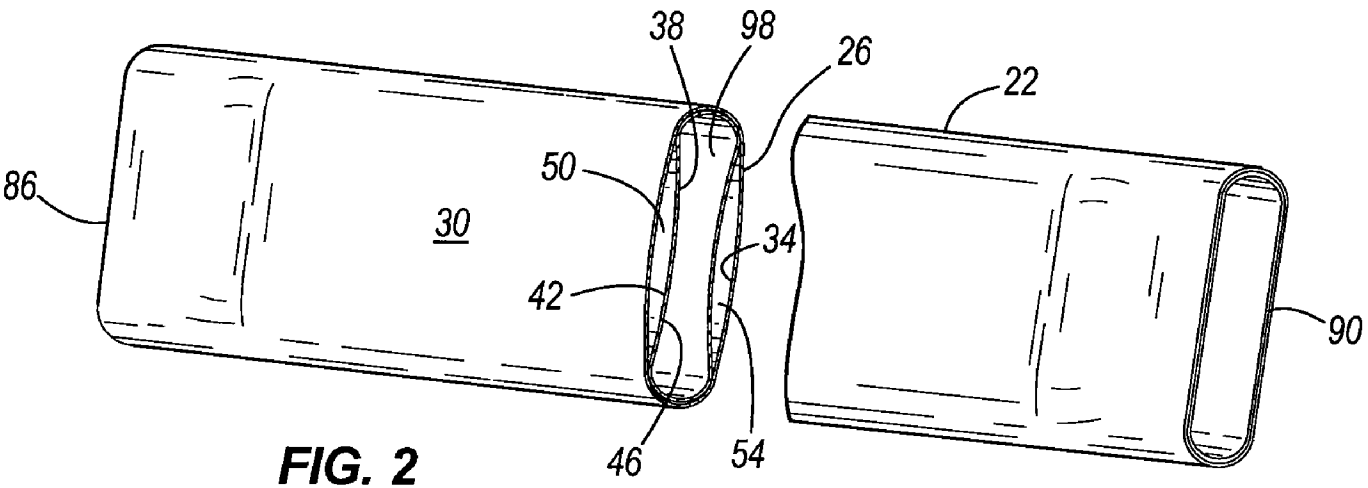
FIG. 2 is perspective view, shown partially in section, of the damper element of FIG. 1.
Figure 7:
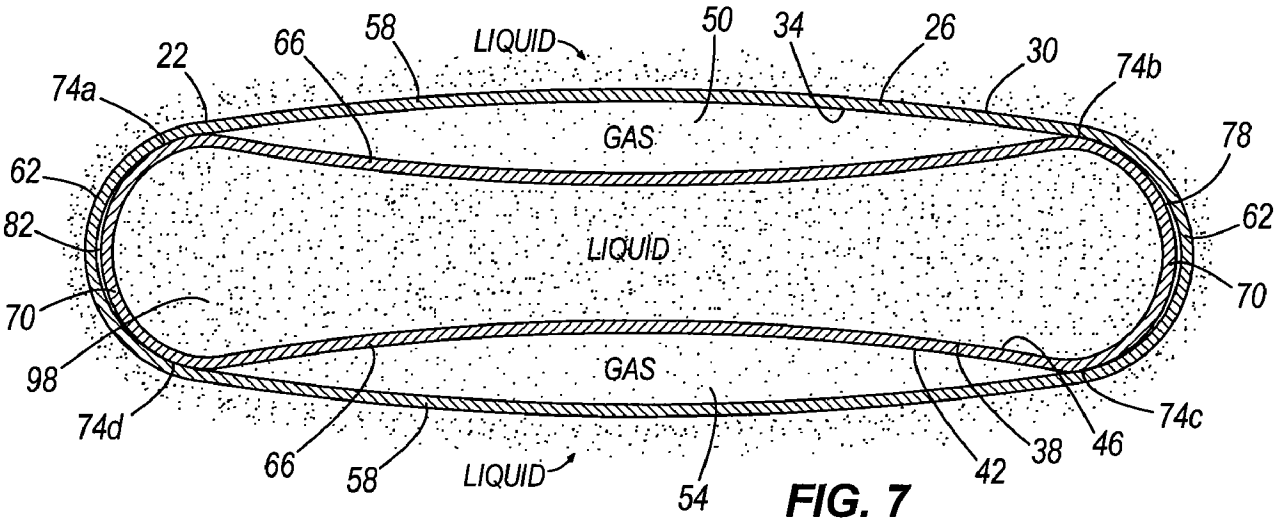
FIG. 7 is a section view taken along line 7-7 of FIG. 6.

With initial reference to FIGS. 2 and 7, the damper element 22 includes an outer tuber 26 having an outer surface 30 and an inner surface 34 defining an interior cavity. The damper element 22 also includes an inner tube 38 having an outer surface 42 and an inner surface 46. The inner tube 38 is positioned within the interior cavity of the outer tube 26 such that at least one chamber for receiving a compressible gas is defined between the inner surface 34 of the outer tuber 26 and the outer surface 42 of the inner tube 38. In the illustrated embodiment, there are two main chambers 50, 54 defined between the inner surface 34 of the outer tube 26 and the outer surface 42 of the inner tube 38.

The two chambers 50, 54 are defined by the respective contouring of the inner and outer tubes 38 and 26. More specifically, and with reference to FIG. 7, the outer tube 26 includes opposite convexly-contoured side portions 58 interconnected by opposite arcuate portions 62. The inner tube 38 includes opposite concavely-contoured side portions 66 interconnected by opposite arcuate portions 70. For purposes of this description, the terms convex and concave describe the curvature taken with respect to the outer surfaces of the tubes 26, 38. The first chamber 50 is defined between one of the convexly-contoured side portions 58 of the outer tube 26 and one of the concavely-contoured side portions 66 of the inner tube 38. The second chamber 54 is defined between the other of the convexly-contoured side portions 58 of the outer tube 26 and the other of the concavely-contoured side portions 66 of the inner tube 38. More generally, the convexly-contoured side portions 58 of the outer tube 26 define wall portions that extend away from the inner tube 38, and the concavely-contoured side portions 66 of the outer tube 38 define wall portions that extend away from the outer tube 26. These oppositely-extending wall portions together define the respective chambers 50, 54.

In the illustrated embodiment, and with continued reference to FIG. 7, the inner tube 38 is press-fit into the interior cavity of the outer tube 26 to define at least two, and more likely four longitudinally-extending zones of contact 74*a-d* between the inner surface 34 of the outer tube 26 and the outer surface 42 of the inner tube 38. The zones of contact 74*a* and 74*b* define the lateral extents of the chamber 50 and the zones of contact 74*c* and 74*d* define the lateral extents of the chamber 54. As best shown in FIG. 7, two small chambers 78 and 82 are formed between the opposite arcuate portions 62 of the outer tube 26 and the respective opposite arcuate portions 70 of the inner tube 38. The zones of contact 74*b* and 74*c* define the lateral extents of the chamber 78, while the zones of contact 74*a* and 74*d* define the lateral extents of the chamber 82.

In the illustrated embodiment, the zones of contact 74*a-d* are formed by the press-fit operation only, and no welding or other bonding techniques are utilized. Such additional bonding in the areas of the zones of contact 74*a-d* could result in increased stresses created in the damper element 22. In addition, while the four zones of contact 74*a-d* could be reduced to two zones of contact by having the inner and outer tubes 38, 26 contact one another along the entire areas between the zones of contact 74*b* and 74*c*, and between the zones of contact 74*a* and 74*d*, such large areas of contact would also significantly increase the stresses created in the damper element 22, and as such, would not be as advantageous as the illustrated construction incorporating the small chambers 78 and 82. In yet another alternative embodiment, the two zones of contact need not extend substantially the entire distance between the illustrated zones of contact 74*b* and 74*c*, and 74*a* and 74*d*, respectively, but rather could be formed at locations intermediate the points 74*b* and 74*c*, and 74*a* and 74*d*, respectively (e.g., at the apices of the arcuate portions 70).

Figure 5B:
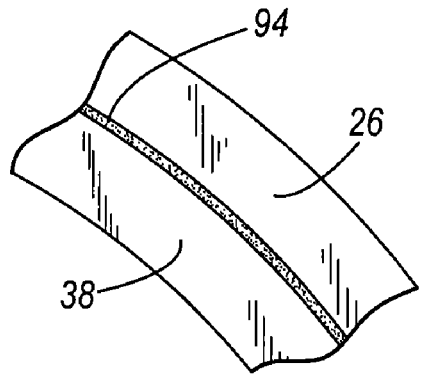
FIG. 5*b* is an enlarged section view of a portion of the damper element illustrated in FIG. 5*a*.
Figure 5A:
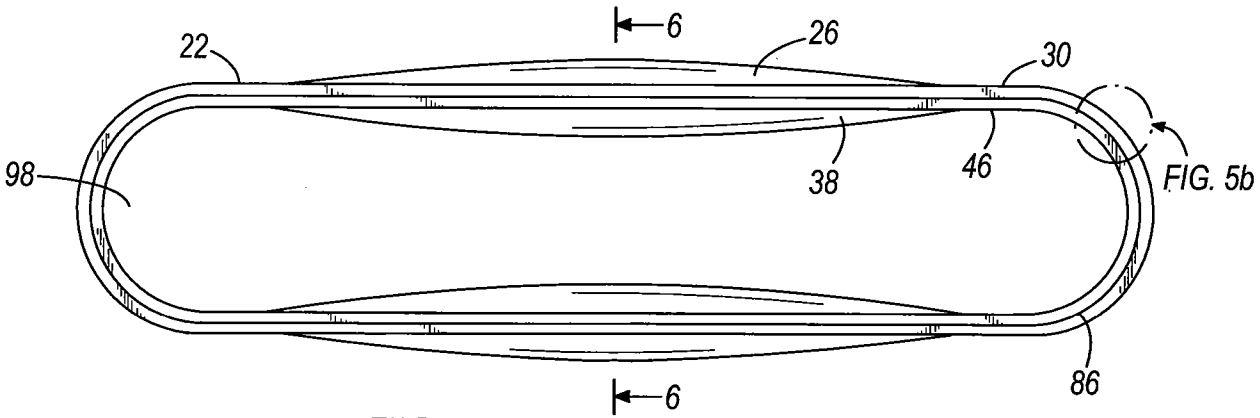
FIG. 5*a* is an end view of the damper element of FIG. 2.
Figure 6:
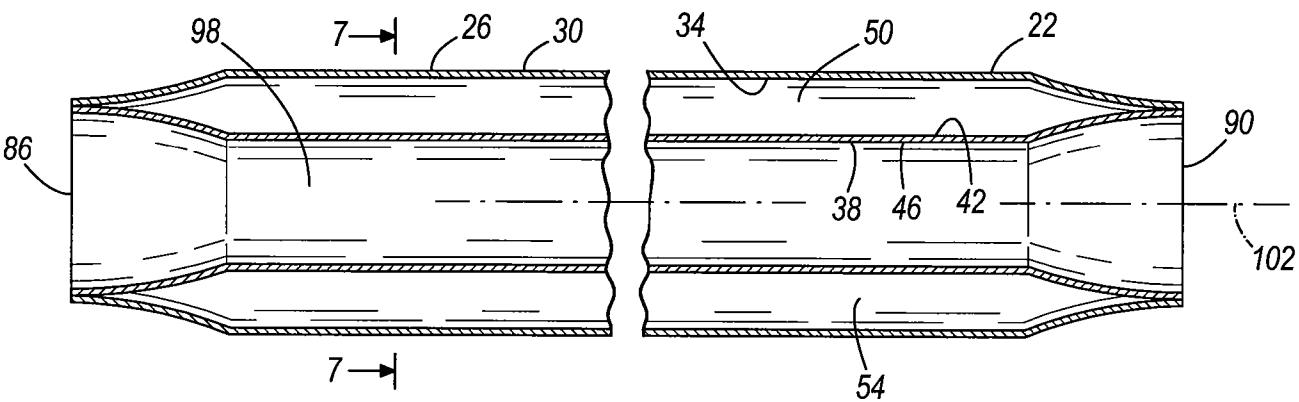
FIG. 6 is a section view taken along line 6-6 of FIG. 5*a*.

As shown in FIGS. 2 and 6, the damper element 22 has a first end 86 defined by the first ends of the inner and outer tubes 38, 26, and a second end 90 defined by the second ends of the inner and outer tubes 38, 26. With reference to FIGS. 5*a* and 5*b*, the respective ends of the inner and outer tubes 38, 26 are sealed to one another along their peripheries, thereby sealing the chambers 50, 54, 78, and 82. As shown in FIG. 5*b*, a sealing layer 94 is formed between the outer and inner tubes 26, 38 by brazing, welding, or other suitable sealing techniques. Any suitable compressible gas (e.g., air, helium, etc.) can be introduced into the chambers 50, 54, 78, and 82 prior to the final sealing of the ends 86 and 90. In the illustrated embodiment, at least ninety-eight percent of the compressible gas is located in the chambers 50 and 54, with only a minimal amount of the compressible gas in the smaller chambers 78 and 82.

The assembled damper element 22 defines an exterior surface (i.e., the outer surface 30 of the outer tube 26) and an interior surface (i.e., the inner surface 46 of the inner tube 38). As shown in FIGS. 7-10, when the damper element 22 is inserted into the fuel rail 14, the exterior surface is surrounded by liquid fuel in the fuel rail 14. Additionally, the interior surface of the damper element 22 defines a passageway 98 extending through the damper element 22 and that is filled by the liquid fuel in the fuel rail 14. Thus, unlike prior art damper elements which define a single, relatively voluminous enclosed gas chamber surrounded on the outside by the liquid fuel, the damper element 22 defines at least two relatively less voluminous, distinct chambers 50, 54 that are symmetrically positioned about a longitudinal axis 102 (see FIG. 6) of the damper element 22. The chambers 50, 54 are spaced apart by the passageway 98 such that both chambers 50, 54 are surrounded by fuel outside the damper element 22 and within the passageway 98 of the damper element 22.

With the two chambers 50, 54 formed on opposite sides of the passageway 98, the damper element 22 has four surfaces that move and deform in response to pressure changes in the fuel. This is twice as many moving surfaces as found on prior art, single-chamber, generally oval-shaped dampers having only two moving surfaces. More moving surfaces and more gas chambers allow a greater volume change of the gas in the chambers 50, 54. Greater volume change results in better damping of pressure pulsations. Thus, for a damper element of generally the same size, material, and material thickness, the two-chamber design of the damper element 22 will experience about two times more gas volume change per bar of fuel pressure change, thereby significantly improving the damping characteristics of the damper element 22 in relation to prior art dampers.

Figure 8:
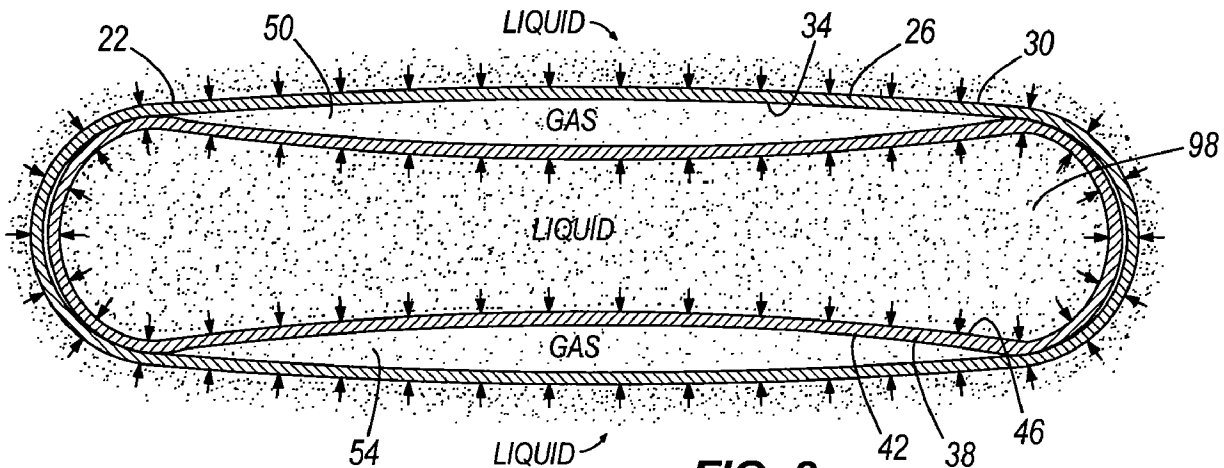
FIG. 8 is a section view similar to FIG. 7 illustrating the damper element in a first substantially deformed state resulting from a first surrounding liquid pressure.

The damper element 22 achieves this increased gas volume change capacity while displacing significantly less fuel than prior art, single-chamber dampers having generally the same outer dimensions. Specifically, the total gas volume in the two chambers 50, 54 is significantly less than the gas volume in a single-chamber, prior art damper having the same outer dimensions. This is due to the passageway 98 between the two chambers, which does not displace any fuel, but rather is filled with the fuel. FIG. 7 illustrates the damper element 22 within the fuel rail when the surrounding fuel is at the ambient pressure (i.e., when the fuel in the fuel rail 14 is not pressurized). FIG. 8 illustrates the damper element 22 in its deformed state when the fuel in the fuel rail 14 is pressurized to the operating pressure (e.g., to about eight bar above ambient pressure). Notice that in FIG. 8, the fuel displacement by the gas volume in the chambers 50, 54 is substantially less than that shown in FIG. 7 just by pressuring the fuel to the normal operating pressure.

The smaller fuel displacement achieved with the damper element 22 means that there is more fuel in the fuel rail 14. Increasing the amount of fuel in the fuel rail 14 reduces the risk of "hot start" and "hot drive away" problems. These are problems that occur when a percentage of the fuel in the fuel rail 14 changes from liquid to vapor. The injectors require liquid fuel to properly supply the combustion chambers, and too much fuel vapor in the rail 14 can be problematic. Because the damper element 22 displaces less fuel than prior art dampers, there is more liquid fuel in the fuel rail. With more liquid fuel, there is a better likelihood that the engine will be able to run long enough with the liquid fuel to properly pressurize and cool the fuel rail 14, thereby allowing any fuel vapor to return to the liquid state. Increasing the amount of fuel in the fuel rail 14 is also advantageous because the fuel in the fuel rail 14 is a compressible liquid that can contribute to pressure pulsation damping.

Figure 9:
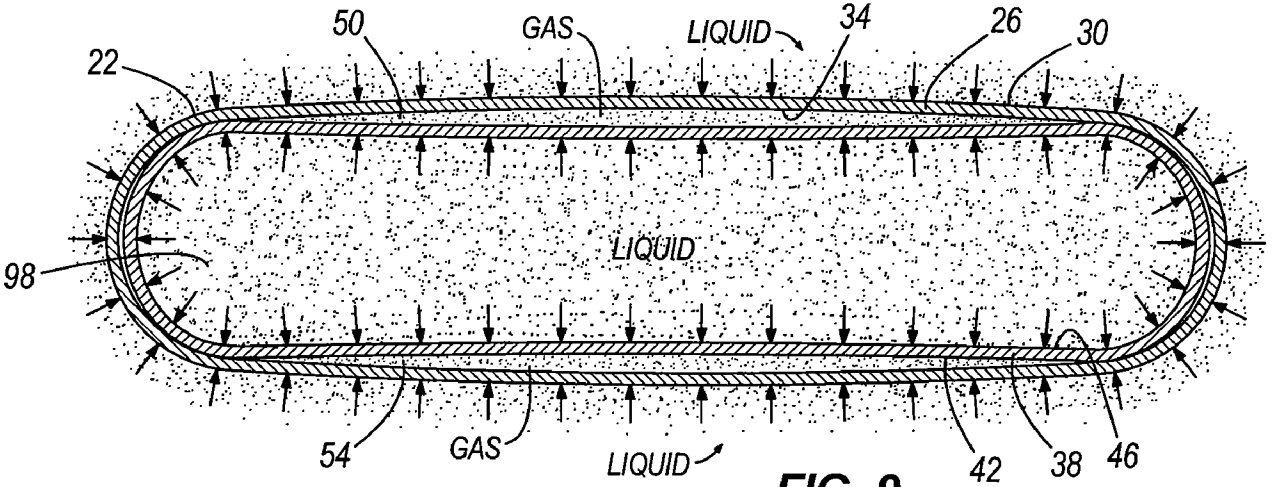
FIG. 9 is a section view similar to FIG. 8 illustrating the damper element in a second substantially deformed state resulting from a second surrounding liquid pressure.
Figure 10:
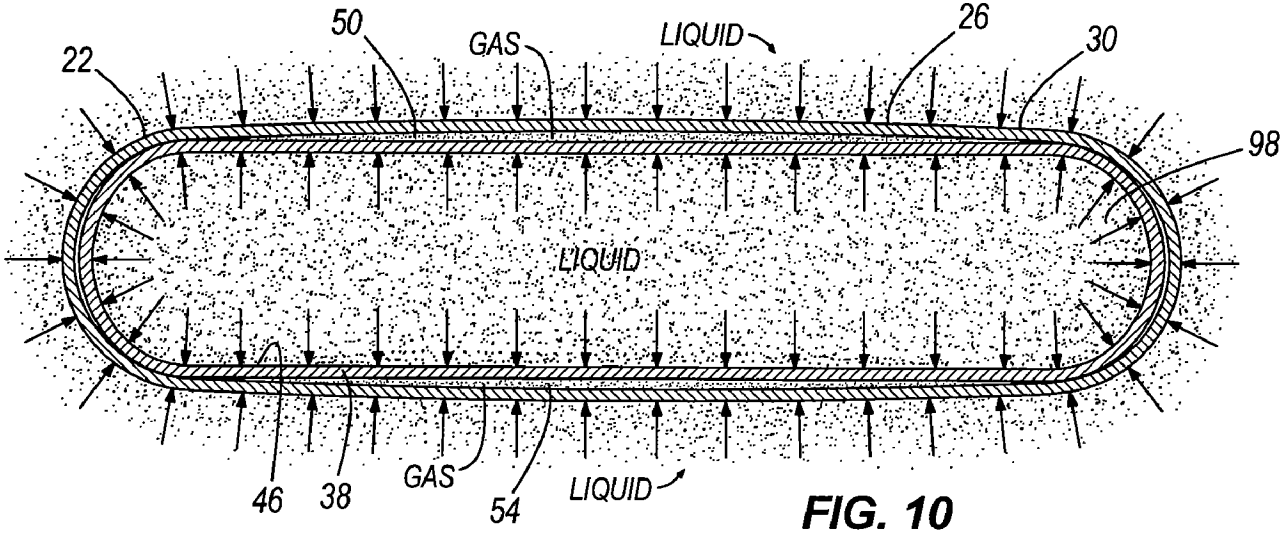
FIG. 10 is a section view similar to FIG. 9 illustrating the damper element in a third substantially deformed state resulting from a third surrounding liquid pressure.

FIG. 9 illustrates the damper element 22 in its deformed state when the fuel pressure in the fuel rail 14 is further increased from the pressure shown in FIG. 8 due to pressure pulsations in the fuel rail 14 (e.g., to about eleven bar above ambient pressure). FIG. 10 illustrates the damper element 22 in its deformed state when the fuel pressure in the fuel rail 14 is further increased toward the maximum expected fuel pressure (e.g., to about 150 bar above ambient pressure). The damper element 22 allows the inner tube 38 and the outer tube 26 walls to come very close together without overstressing the metal tubes. This allows the gas in the chambers 50, 54 to be compressed to a very high pressure without overstressing the metal tubes 26, 38. This significant gas chamber compression was not possible with prior art damper designs.

The tubes 26, 38 are made from any suitable fuel-resistant metals that have a high ratio of endurance strength to modulus of elasticity. These materials can reliably provide the larger gas chamber volume change per bar of fuel pressure change sought by the present damper element design. Examples of suitable materials include stainless steels and precision drawn aluminum tubing that is anodized or otherwise treated for corrosion resistance.

The damper element 22 makes use of all three available "springs" in the fuel rail system to dampen pressure pulsations. First, as discussed above, by displacing less fuel than prior art fuel rails, the damper element 22 makes use of a greater fuel spring present in the increased amount of compressible fuel in the fuel rail 14. Second, the damper element 22 makes use of the metal spring that is the bending and deformation of the inner and outer tubes 38, 26. Third, the damper element 22 makes greatly increased use of the gas spring that is the compression of the gas housed within the chambers 50 and 54. The damper element 22 uses these three "springs," and most significantly, the combined metal spring and gas spring to balance the outside forces of the fuel pressure acting on the damper element 22.

The metal spring has a linear spring rate, while the gas spring has a non-linear spring rate. The linear spring rate of the metal tube surfaces contributes significantly to increasing the volume change in the chambers 50, 54 per bar of change in fuel pressure. The non-linear spring rate of the gas in the chambers 50, 54 helps to greatly dampen the natural frequency of the metal tube surfaces, meaning that the chances that the damper element 22 will be excited by external vibration inputs is greatly reduced. This enables the damper element 22 to dampen more effectively.

While the damping characteristics of prior art single-chamber dampers are mainly a function of the metal spring of the moving damper walls, the damper element 22 relies much more on the increased gas spring capacity that exists due to the presence of the two gas chambers 50, 54. The wall thickness of the tubes 26, 38 can be reduced due to the ample gas spring provided by the compressed gas in the relatively small-volume chambers 50, 54. Thinner tube walls result in an increased ability of the walls to deflect, thereby increasing the gas volume change capability of the damper element 22. The increased gas spring helps insure that the thinner metal will not be overstressed and that it will still meet the fatigue life for the damper element 22. In the illustrated embodiment, the fatigue endurance requirement is based on 1,000,000 fuel pressure cycles taken from ambient pressure to the fuel rail operating pressure and back to the ambient pressure. Because of the thinner tube walls and the increased gas spring, the rate of acceleration of the damper element moving surfaces is increased, providing a damper element 22 that is extremely sensitive to pressure changes in the fuel rail 14 and that quickly reacts to these pressure changes. Additionally, the low mass of the moving walls combined with the high spring rate of the damper element 22 produces a damper that has a very high natural frequency that will be more effective at damping the pressure pulsations in the fuel rail.

The inner and outer tubes 38, 26 of the damper element 22 are designed using finite element analysis (FEA) or other suitable modeling techniques to achieve the desired cross-sectional tube configurations. Starting with a generally oval shape (as shown in FIG. 2 at the end 90) for the inner tube 38, a small external pressure (P1)) is applied to the FEA model to determine the maximum stress (S1max) in this model as a function of this small external pressure (P1)). The fatigue endurance strength (ES) based on the tube material being modeled is known. Next, a new external pressure (P2)) substantially equal to ((ES/S1max)*P1)) is applied to the model to determine the deflection that will ultimately define the concavely-contoured side portions 66. Then, if it is verified that the maximum stress in this FEA model at the new pressure (P2)) is substantially equal to the fatigue endurance strength (ES) of the material, the shape of the inner tube 38 that was created by the external pressure (P2)) will be used for the manufactured inner tube 38 in its free state (i.e., the shape with no pressure acting on the inner tube 38). To verify that this resultant cross-sectional shape for the inner tube 38 is appropriate, it is then modeled with an internal pressure (P2)) applied to the FEA model with the following results: (1) the maximum stress (S1max) was equal to the fatigue endurance strength (ES); and (2) the shape returned to the original generally oval shape (as shown in FIG. 2 at the end 90). The inner tube 38 can then be formed to this shape via extrusion or other suitable forming processes. If the inner tube 38 is extruded, but yet requires a longitudinal weld, the weld should be located at the lowest stress area of the tube 38.

The outer tube 26 is designed similarly. Starting with a generally oval shape (as shown in FIG. 2 at the end 90) for the outer tube 26, a small internal pressure (P1)) is applied to the FEA model to determine the maximum stress (S1max) in this model as a function of this small internal pressure (P1)). The fatigue endurance strength (ES) based on the tube material being modeled is known. Next, a new internal pressure (P2)) substantially equal to ((ES/S1max)*P1)) is applied to the model to determine the deflection that will ultimately define the convexly-contoured side portions 58. Then, if it is verified that the maximum stress in this FEA model at the new pressure (P2)) is substantially equal to the fatigue endurance strength (ES) of the material, the shape of the outer tube 26 that was created by the internal pressure (P2)) will be used for the manufactured outer tube 26 in its free state (i.e., the shape with no pressure acting on the outer tube 26). To verify that this resultant cross-sectional shape for the outer tube 26 is appropriate, it is then modeled with an external pressure (P2)) applied to the FEA model with the following results: (1) the maximum stress (S1max) was equal to the fatigue endurance strength (ES); and (2) the shape returned to the original generally oval shape (as shown in FIG. 2 at the end 90). The outer tube 26 can then be formed to this shape via extrusion or other suitable forming processes. As with the inner tube 38, if the outer tube 26 is extruded, but yet requires a longitudinal weld, the weld should be located at the lowest stress area of the tube 26.

This process can be remodeled for each change to the height, thickness, and/or width of each tube 26, 38. Each combination will be used to optimize the damper element 22 for package size and for the lowest ratio of change in displaced volume of the damper element 22 to change in pressure measured at the operating pressure of the fuel rail 14.

With this design method, each point on the inner and outer tubes 38, 26 will come together under pressure increases at the same rate in a very controlled manner. Furthermore, the damper element 22 can be optimized for the operating pressure of the specific fuel rail 14 in which the damper element 22 will be used. The thickness and shapes of the tubes 26, 38 are selected based on an infinite fatigue life for the damper element 22. The design intent is to operate the damper element 22 at the endurance stress level for both the inner and outer tubes 38, 26. The volume of gas reduction in the chambers 50, 54 caused by the surfaces of the inner and outer tubes 38, 26 moving closer together until the endurance stress level is reached is used to determine the initial gas volume in the chambers 50, 54. Using the standard equation $P_1V_1=P_2V_2$, the gas pressure in the chambers 50, 54 can be determined for any point.

The design is optimized by getting the most metal spring possible from the thin metal tube walls, and then having the gas spring compensate for the remaining pressure differences. At pressures of more than forty bars above ambient, the thin metal walls of the damper element 22 provide little or no significant resistance to deflection, however, the increased gas pressure in the chambers 50, 54 resists deflection of the damper element walls to absorb the exterior pressures that would otherwise over-stress prior art dampers with walls of this thickness.

Figure 3:
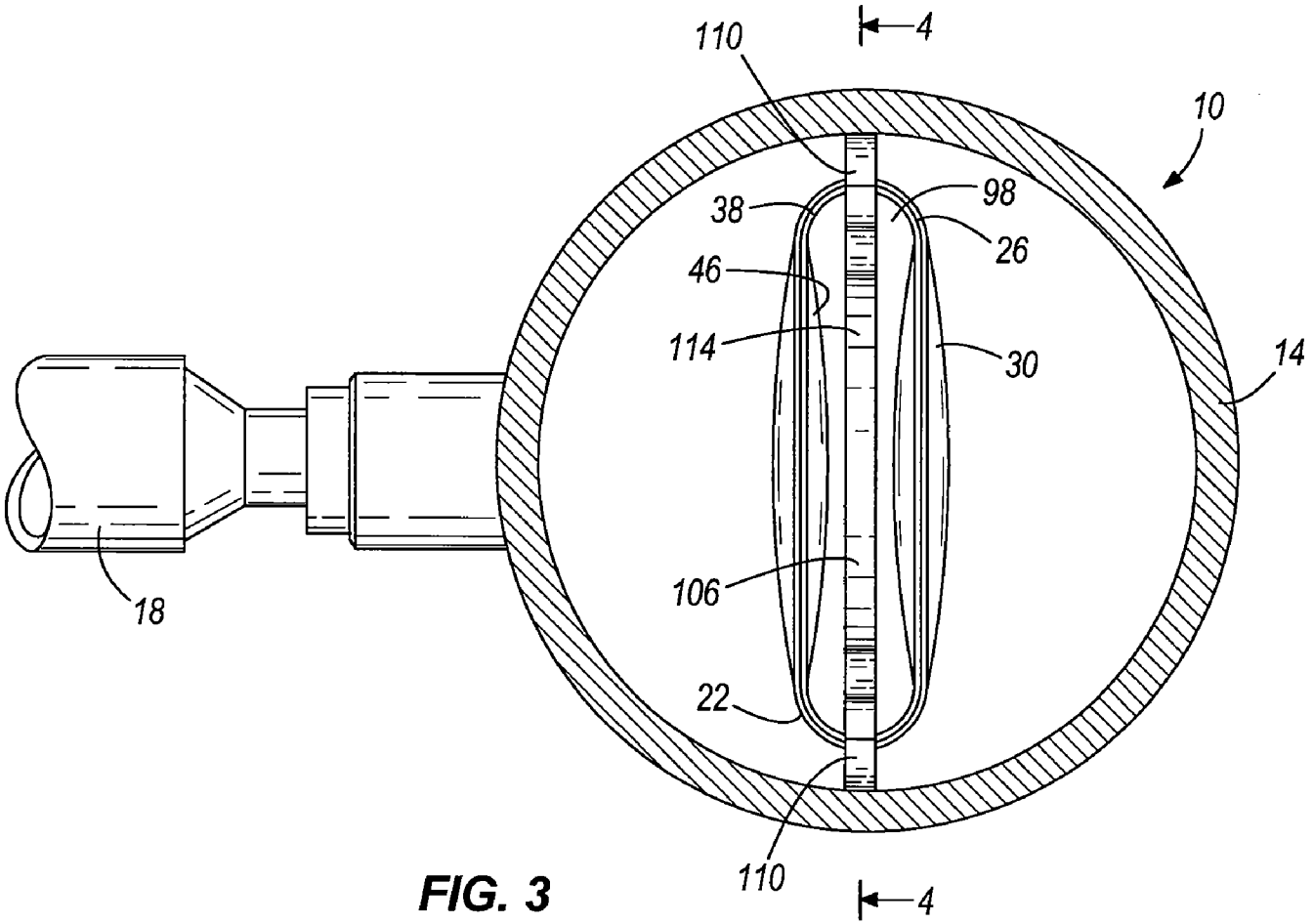
FIG. 3 is a section view taken along line 3-3 of FIG. 1.
Figure 4:
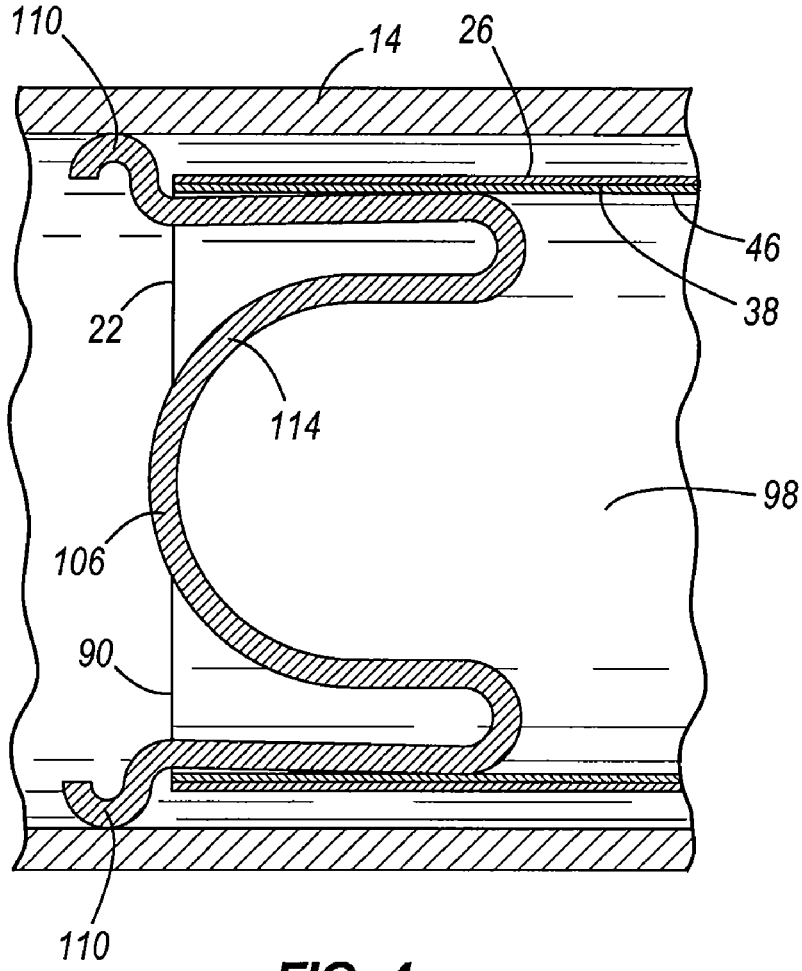
FIG. 4 is a section view taken along line 4-4 of FIG. 3.

With reference to FIGS. 1, 3, and 4, the damper element 22 is positioned within the fuel rail 14 using resilient locating members 106 (only one is shown). The illustrated locating member 106 is made of spring steel and includes opposite end portions 110 configured to be biased into engagement with the inner surface of the fuel rail 14. A resilient body portion 114 extends between the end portions 110 and is configured to be received in the passageway 98 of the damper element and to engage the inner surface 46 of the inner tube 38, thereby supporting and positioning the damper element 22 within the fuel rail 14. While the locating member 106 is shown as having a square cross-section, those skilled in the art will understand that other suitable cross-sectional shapes (e.g., round, rectangular, etc.) can also be substituted. Additionally, those skilled in the art will understand that alternative methods of positioning the damper element 22 in the fuel rail 14 can also be used.

Various features of the invention are set forth in the following claims.

What is claimed is:

1. A damper element for damping pressure pulsations in a liquid, the damper element comprising:

an outer tube having an inner surface defining an interior cavity and an outer surface configured to be surrounded by the liquid;

an inner tube positioned within the interior cavity of the outer tube, the inner tube including an outer surface; and at least one chamber formed between the inner surface of the outer tube and the outer surface of the inner tube for containing a gas;

wherein the outer tube has a wall portion extending away from the inner tube and the inner tube has a wall portion extending away from the outer tube, the wall portions being generally aligned with one another to define therebetween at least a portion of the at least one chamber.

2. The damper element of claim 1, wherein at least two chambers are formed between the inner surface of the outer tube and the outer surface of the inner tube, the at least two chambers not in fluid communication with one another.

3. The damper element of claim 2, wherein the at least two chambers are symmetrically positioned about a longitudinal axis of the damper element.

4. The damper element of claim 2, wherein the inner tube includes an inner surface configured to define a passageway through the damper element for the liquid; and wherein the at least two chambers are spaced apart by the passageway.

5. The damper element of claim 1, wherein the outer tube includes opposite convexly-contoured side portions interconnected by opposite arcuate portions;

wherein the inner tube includes opposite concavely-contoured side portions interconnected by opposite arcuate portions;

wherein a first chamber is formed between one of the convexly-contoured side portions of the outer tube and one of the concavely-contoured side portions of the inner tube; and wherein a second chamber is formed between the other of the convexly-contoured side portions of the outer tube and the other of the concavely-contoured side portions of the inner tube.

6. The damper element of claim 1, wherein the inner tube is press-fit into the interior cavity of the outer tube.

7. The damper element of claim 1, wherein there are at least two longitudinally-extending zones of contact defined between the outer and inner tubes to define at least two chambers between the inner surface of the outer tube and the outer surface of the inner tube, the at least two chambers not in fluid communication with one another.

8. The damper element of claim 7, wherein the at least two longitudinally-extending zones of contact are created by press-fitting the inner tube into the interior cavity of the outer tube.

9. The damper element of claim 7, wherein there are four longitudinally-extending zones of contact defined between the outer and inner tubes to define four chambers between the inner surface of the outer tube and the outer surface of the inner tube.

10. The damper element of claim 1, wherein the outer and inner tubes are extruded.

11. The damper element of claim 1, wherein ends of the outer tube are sealed to respective ends of the inner tube to form the at least one chamber.

12. The damper element of claim 1, wherein the inner tube includes an inner surface configured to define a passageway through the damper element for the liquid.

13. A damper element for damping pressure pulsations in a liquid, the damper element comprising:

an exterior surface configured to be surrounded by the liquid;

an interior surface configured to define a passageway through the damper element for the liquid; and at least one chamber formed between the interior and exterior surfaces for containing a gas;

wherein the damper element includes:

an outer tube having an inner surface defining an interior cavity; and an inner tube positioned within the interior cavity of the outer tube;

wherein the outer tube includes opposite convexly-contoured side portions interconnected by opposite arcuate portions;

wherein the inner tube includes opposite concavely-contoured side portions interconnected by opposite arcuate portions;

wherein a first chamber is formed between one of the convexly-contoured side portions of the outer tube and one of the concavely-contoured side portions of the inner tube; and wherein a second chamber is formed between the other of the convexly-contoured side portions of the outer tube and the other of the concavely-contoured side portions of the inner tube.

14. The damper element of claim 13, wherein the first and second chambers are not in fluid communication with one another.

15. The damper element of claim 13, wherein the first and second chambers are spaced apart by the passageway.

16. The damper element of claim 13, wherein the first and second chambers are symmetrically positioned about a longitudinal axis of the damper element.

17. The damper element of claim 13, wherein there are at least two longitudinally-extending zones of contact defined between the outer and inner tubes to define the first and second chambers between the inner surface of the outer tube and an outer surface of the inner tube, the first and second chambers not in fluid communication with one another.

18. The damper element of claim 17, wherein the at least two longitudinally-extending zones of contact are created by press-fitting the inner tube into the interior cavity of the outer tube.

19. The damper element of claim 17, wherein there are four longitudinally-extending zones of contact defined between the outer and inner tubes to define four chambers between the inner surface of the outer tube and the outer surface of the inner tube.

20. The damper element of claim 13, wherein the outer and inner tubes are extruded.

21. The damper element of claim 13, wherein ends of the outer tube are sealed to respective ends of the inner tube to form the at least one chamber between the inner surface of the outer tube and an outer surface of the inner tube.

22. A fuel rail assembly comprising:

a fuel rail configured to receive fuel; and a damper element in the fuel rail for damping pressure pulsations in the fuel, the damper element including;

an outer tube having an inner surface defining an interior cavity;

an inner tube positioned within the interior cavity of the outer tube, the inner tube including an outer surface; and at least one chamber formed between the inner surface of the outer tube and the outer surface of the inner tube for containing a gas;

wherein the outer tube includes opposite convexly-contoured side portions interconnected by opposite arcuate portions;

wherein the inner tube includes opposite concavely-contoured side portions interconnected by opposite arcuate portions;

wherein a first chamber is formed between one of the convexly-contoured side portions of the outer tube and one of the concavely-contoured side portions of the inner tube; and wherein a second chamber is formed between the other of the convexly-contoured side portions of the outer tube and the other of the concavely-contoured side portions of the inner tube.

23. The fuel rail assembly of claim 22, wherein the first and second chambers are not in fluid communication with one another.

24. The fuel rail assembly of claim 22, wherein the first and second chambers are symmetrically positioned about a longitudinal axis of the damper element.

25. The fuel rail assembly of claim 22, wherein the outer tube includes an outer surface configured to be surrounded by the fuel;

wherein the inner tube includes an inner surface configured to define a passageway through the damper element for the fuel; and wherein the first and second chambers are spaced apart by the passageway.

26. The fuel rail assembly of claim 22, wherein the inner tube is press-fit into the interior cavity of the outer tube.

27. The fuel rail assembly of claim 22, wherein there are at least two longitudinally-extending zones of contact defined between the outer and inner tubes to define the first and second chambers between the inner surface of the outer tube and the outer surface of the inner tube, the first and second chambers not in fluid communication with one another.

28. The fuel rail assembly of claim 27, wherein the at least two longitudinally-extending zones of contact are created by press-fitting the inner tube into the interior cavity of the outer tube.

29. The fuel rail assembly of claim 27, wherein there are four longitudinally-extending zones of contact defined between the outer and inner tubes to define four chambers between the inner surface of the outer tube and the outer surface of the inner tube.

30. The fuel rail assembly of claim 22, wherein the outer and inner tubes are extruded.

31. The fuel rail assembly of claim 22, wherein ends of the outer tube are sealed to respective ends of the inner tube to form the at least one chamber.

32. The fuel rail assembly of claim 22, wherein the outer tube includes an outer surface configured to be surrounded by the fuel; and wherein the inner tube includes an inner surface configured to define a passageway through the damper element for the fuel.

33. The fuel rail assembly of claim 22, further comprising:

a locating member coupled between the damper element and the fuel rail for positioning the damper element within the fuel rail.

34. The fuel rail assembly of claim 33, wherein the inner tube includes an inner surface and wherein the fuel rail includes an inner surface, the locating member engaging both the inner surface of the inner tube and the inner surface of the fuel rail.

35. The fuel rail assembly of claim 33, wherein the locating member is made from spring steel and includes opposite ends biased into engagement with an inner surface of the fuel rail.

36. A fuel rail assembly comprising:

a fuel rail configured to receive fuel; and a damper element in the fuel rail for damping pressure pulsations in the fuel, the damper element including;

an exterior surface configured to be surrounded by the fuel;

an interior surface configured to define a passageway through the damper element for the fuel; and at least one chamber formed between the interior and exterior surfaces for containing a gas;

wherein the damper element includes:

an outer tube having an inner surface defining an interior cavity; and an inner tube positioned within the interior cavity of the outer tube;

wherein the outer tube has a wall portion extending away from the inner tube and the inner tube has a wall portion extending away from the outer tube, the wall portions being generally aligned with one another to define therebetween at least a portion of the at least one chamber.

37. The fuel rail assembly of claim 36, wherein at least two chambers are formed between the interior and exterior surfaces for containing a gas, the at least two chambers not in fluid communication with one another.

38. The fuel rail assembly of claim 37, wherein the at least two chambers are spaced apart by the passageway.

39. The fuel rail assembly of claim 37, wherein the at least two chambers are symmetrically positioned about a longitudinal axis of the damper element.

40. The fuel rail assembly of claim 36, wherein the outer tube includes opposite convexly-contoured side portions interconnected by opposite arcuate portions;

wherein the inner tube includes opposite concavely-contoured side portions interconnected by opposite arcuate portions;

wherein a first chamber is formed between one of the convexly-contoured side portions of the outer tube and one of the concavely-contoured side portions of the inner tube; and wherein a second chamber is formed between the other of the convexly-contoured side portions of the outer tube and the other of the concavely-contoured side portions of the inner tube.

41. The fuel rail assembly of claim 36, wherein there are at least two longitudinally-extending zones of contact defined between the outer and inner tubes to define at least two chambers between the inner surface of the outer tube and an outer surface of the inner tube, the at least two chambers not in fluid communication with one another.

42. The fuel rail assembly of claim 41, wherein the at least two longitudinally-extending zones of contact are created by press-fitting the inner tube into the interior cavity of the outer tube.

43. The fuel rail assembly of claim 41, wherein there are four longitudinally-extending zones of contact defined between the outer and inner tubes to define four chambers between the inner surface of the outer tube and the outer surface of the inner tube.

44. The fuel rail assembly of claim 36, wherein the outer and inner tubes are extruded.

45. The fuel rail assembly of claim 36, wherein ends of the outer tube are sealed to respective ends of the inner tube to form the at least one chamber between the inner surface of the outer tube and an outer surface of the inner tube.

46. The fuel rail assembly of claim 36, further comprising:

a locating member coupled between the damper element and the fuel rail for positioning the damper element within the fuel rail.

47. The fuel rail assembly of claim 46, wherein a portion of the locating member is received in the passageway and engages the interior surface, and a portion of the locating member extends out of the passageway and engages an inner surface of the fuel rail.

48. The fuel rail assembly of claim 46, wherein the locating member is made from spring steel and includes opposite ends biased into engagement with an inner surface of the fuel rail.

49. A damper element for damping pressure pulsations in a liquid, the damper element comprising:

an outer tube having an inner surface defining an interior cavity;

an inner tube positioned within the interior cavity of the outer tube, the inner tube including an outer surface; and at least one chamber formed between the inner surface of the outer tube and the outer surface of the inner tube for containing a gas;

wherein the inner tube is press-fit into the interior cavity of the outer tube.

50. The damper element of claim 49, wherein at least two chambers are formed between the inner surface of the outer tube and the outer surface of the inner tube.

51. The damper element of claim 50, wherein the at least two chambers are symmetrically positioned about a longitudinal axis of the damper element.

52. The damper element of claim 50, wherein the inner tube includes an inner surface configured to define a passageway through the damper element for the liquid; and wherein the at least two chambers are spaced apart by the passageway.

53. The damper element of claim 49, wherein there are at least two longitudinally-extending zones of contact defined between the outer and inner tubes to define at least two chambers between the inner surface of the outer tube and the outer surface of the inner tube.

54. The damper element of claim 53, wherein there are four longitudinally-extending zones of contact defined between the outer and inner tubes to define four chambers between the inner surface of the outer tube and the outer surface of the inner tube.

55. A damper element for damping pressure pulsations in a liquid, the damper element comprising:

an outer tube having an inner surface defining an interior cavity and an outer surface configured to be surrounded by the liquid;

an inner tube positioned within the interior cavity of the outer tube, the inner tube including an outer surface; and at least one chamber formed between the inner surface of the outer tube and the outer surface of the inner tube for containing a gas;

wherein at least two chambers are formed between the inner surface of the outer tube and the outer surface of the inner tube, the at least two chambers not in fluid communication with one another.

56. The damper element of claim 55, wherein the at least two chambers are symmetrically positioned about a longitudinal axis of the damper element.

57. The damper element of claim 55, wherein the inner tube includes an inner surface configured to define a passageway through the damper element for the liquid; and wherein the at least two chambers are spaced apart by the passageway.

* * * * *